US005216202A

United States Patent [19]

Yoshida et al.

[11] Patent Number: 5,216,202

[45] Date of Patent: Jun. 1, 1993

[54] METAL-SHIELDED CABLE SUITABLE FOR ELECTRONIC DEVICES

[75] Inventors: Tokuji Yoshida; Kiyomitsu Asano; Tokugoro Mizukami, all of Tokyo; Katsuo Endo; Nobuhito Akutsu, both of Ibaraki, all of Japan

[73] Assignees: Yoshida Kogyo K.K.; Hitachi Cable Ltd., both of Tokyo, Japan

[21] Appl. No.: 748,289

[22] Filed: Aug. 21, 1991

[30] Foreign Application Priority Data

Aug. 21, 1990 [JP] Japan ..... 2-219402
Feb. 19, 1991 [JP] Japan ..... 3-46206

[51] Int. Cl.[5] ..... H01B 7/34

[52] U.S. Cl. ..... 174/36; 174/106 R; 174/107; 174/109

[58] Field of Search ..... 174/36, 106 R, 107, 174/108, 109

[56] References Cited

U.S. PATENT DOCUMENTS

| | | | |
|---|---|---|---|
| 305,475 | 9/1884 | Reed | 174/47 |
| 2,032,712 | 3/1936 | Morrison et al. | 174/107 |
| 2,527,172 | 10/1950 | Beaver et al. | 174/106 R |
| 4,281,211 | 7/1981 | Tatum et al. | 174/36 |
| 4,409,427 | 10/1983 | Plummer, III | 174/36 |
| 4,477,693 | 10/1984 | Krafec et al. | 174/36 |
| 4,510,346 | 4/1985 | Bursh, Jr. et al. | 174/36 |
| 4,684,762 | 8/1987 | Gladfelter | 174/36 |
| 4,791,236 | 12/1988 | Klein et al. | 174/36 |

FOREIGN PATENT DOCUMENTS

| | | | |
|---|---|---|---|
| 105806 | 5/1991 | Japan | 174/36 |
| 1582808 | 1/1981 | United Kingdom . | |
| 2155686 | 9/1985 | United Kingdom . | |
| 2201829 | 9/1988 | United Kingdom . | |

*Primary Examiner*—Morris H. Nimmo
*Attorney, Agent, or Firm*—Helfgott & Karas, P.C.

[57] ABSTRACT

A metal-shielded cable includes a core made of insulated wires each having a conductor coated with an insulation layer. The core is surrounded with a composite metal shield which includes a laminated metal-plastic layer and a shield layer. The shield layer includes a tape formed of woven filaments, which is wound around or aligned longitudinally along the core of the cable.

15 Claims, 7 Drawing Sheets

METAL-SHIELDED CABLE SUITABLE FOR ELECTRONIC DEVICES

FIELD OF THE INVENTION

The present invention relates to a metal-shielded cable suitable for electronic devices, particularly to a metal-shielded cable suitable for electronic devices having improved productivity, flexibility and terminal handling facility with shielding effect similar or superior to a conventional cable having a braided metal shield.

BACKGROUND OF THE INVENTION

In recent years, digital electronic devices have been improved in precision and sensitivity with greater compactness, attaching greater importance to protection against electromagnetic noises.

Furnishing a cable core with a shield layer around it is a common way of protecting a cable from electromagnetic noises. Shield layers which have been used heretofore include braided threads of tin-plated annealed copper, a copper tape wound around the core, an aluminum pipe, a polyester tape with evaporated aluminum or copper thereon wound around or aligned along the core, coating of conductive composition containing carbon or metal particles.

A double-layered shield consisting of a laminated metal-plastic tape, such as a laminated aluminum-polyester tape, and a metal shield formed of braided or wound metal wires has been used frequently, not only for shielding but for preventing moisture from coming into the core to improve the line reliability.

For instance, a cable core consisting of stranded wires each having a conductor covered with an insulation layer is surrounded with a shield consisting of a laminated aluminum-polyester tape and a braided metal wire, further covered with a protective sheath.

Braiding of metal strands is carried out only at a limited speed because the operation of braiding a plurality of metal wires is rather complicated. As the process of braiding metal wires follows the processes of core stranding and tape winding which can be carried out at higher speeds, storage of the core in reservoir bobbins prior to braiding is required, thus the overall efficiency of manufacturing process being lowered.

Terminal handling for connection, branching etc. of the cable lines requires removal of braided wire shield in a certain length from an end of the cable. The braided wires which form a cylindrical layer in close contact with the core have to be removed by a special scissor-like tool by a laborious operation.

Flexibility of a cable is lowered by the braided shield attached thereto, more remarkably with the increasing density of braiding, because the wire strands are braided in a cylindrical shape in close contact with the cable core.

SUMMARY OF THE INVENTION

Accordingly, an object of the invention is to provide a metal-shielded cable suitable for electronic devices which can be manufactured with a high efficiency of production.

Another object of the invention is to provide a metal-shielded cable suitable for electronic devices having shielding effect similar or superior to a conventional braided metallic wire shield.

Still another object of the invention is to provide a metal-shielded cable suitable for electronic devices having improved flexibility. Further object of the invention is to provide a metal-shielded cable suitable for electronic devices from which the shield can be removed easily.

According to the invention, there is provided a metal-shielded cable suitable for electronic devices in which a cable core consisting of insulated wires, which may be stranded, each having a conductor covered with an insulation layer, is surrounded with a composite metal shield having a laminated metal-plastic layer and a shield layer formed of metal filaments in combination, wherein:

the shield layer formed of metal filaments comprises a tape formed of woven metal filaments which is wound helically around or aligned longitudinally along the cable core with the edge portions partly overlapping the respective neighboring edge.

The woven metal layer may be interposed between the core and the laminated metal-plastic tape, optionally in direct contact with the core, or the laminated metal-plastic tape may be interposed between the core and the woven metal layer. Either of the layer of woven metal filaments or the laminated metal-plastic layer may be located inner, i.e. adjacent to the cable core. A cable in which a layer of woven metal filaments is interposed between two layers of laminated metal-plastic layers exhibits excellent shield effect. The arrangement in which the metal layer of a laminated metal-plastic structure, especially in the form of a tape, comes into contact with the woven metal layer is preferred, because the metal layers can readily slip each other, increasing flexibility of the cable.

Either of the warps or wefts in part, or the entirety of either one, may be formed of synthetic fibers such as polyester fibers. The use of artificial fiber to such an extent that the shield effect is not impaired increases the flexibility of tape, thus, of cable, preventing frequent breaking of the thread so as to improve the efficiency of production. The manner of weaving may be plain weaving in which every single warp and weft cross each other, or may be twill weaving.

The woven metal layer in the metal-shielded cable according to the invention consists of a tape or tapes formed of woven metal filaments which may contain additional synthetic fibers. The tape or tapes of woven metal filaments may be wound helically around or aligned longitudinally along the cable core, preferably with the edge portions overlapping each other, up to 1/2 of the tape width, so as to wrap the cable core. Such overlapping of the adjacent portions of the tape or tapes facilitates the movement each other of the portions of the cylindrical layer of woven metal filaments, especially in the axial direction, whereby the flexibility of the cable is greatly improved. Such axial movement of parts is not permitted at all by the conventional layer of braided metal filaments which form a cylindrical structure tightly surrounding the cable core.

The composite layer structure of woven metal and metal-plastic laminate provides an excellent shield effect, as well as the latter protects the cable core from moisture.

BRIEF DESCRIPTION OF THE DRAWINGS

The present invention will be explained in more detail in accordance with the following drawings, wherein.

DESCRIPTION OF THE PREFERRED EMBODIMENTS

Figure 1:
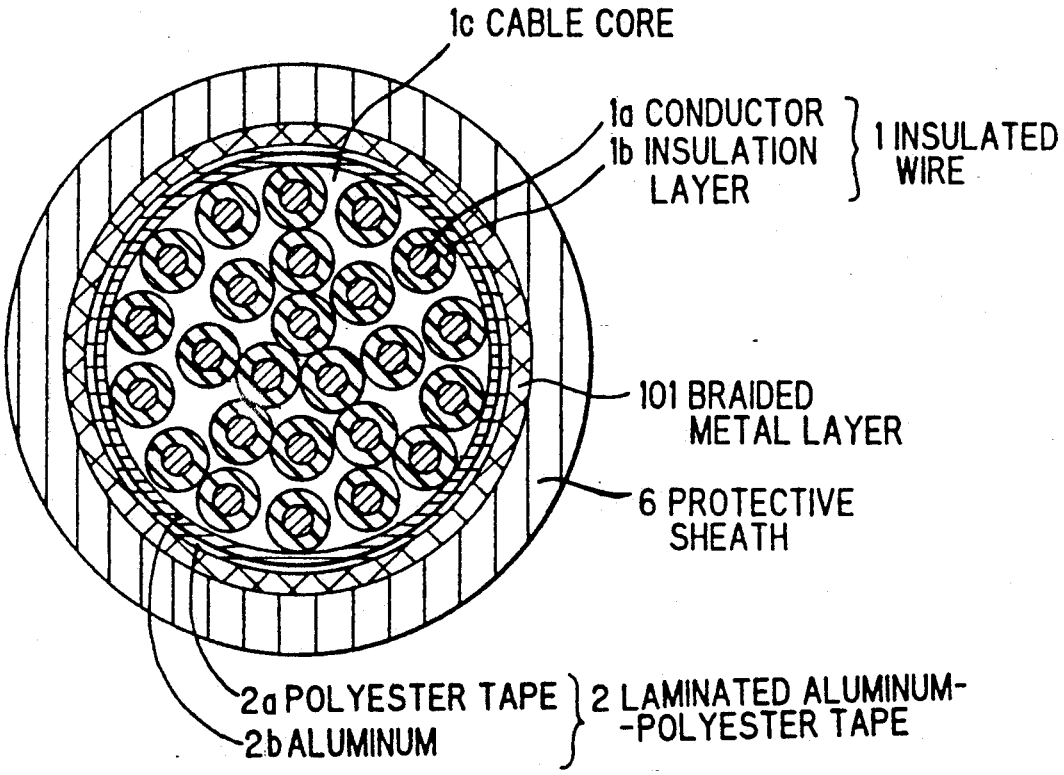
FIG.1 PRIOR ART
FIG. 1 shows a cross-sectional view of a conventional metal-shielded cable for electronic devices.

Before explaining metal-shielded cables for electronic devices in preferred embodiments of the invention, the aforementioned conventional metal-shielded cable for electronic devices will be explained with reference to FIG. 1.

In a conventional metal-shielded cable for electronic devices, stranded wires 1 each comprising a conductor 1*a* and an insulation layer 1*b* to form a cable core 1*c* is surrounded by a double-layered metal shield consisting of a laminated aluminum-polyester tape 2 and a layer of braided metal filaments 101, covered further with a protective sheath 6.

Next, a detailed description will now be given of a metal-shielded cable in a preferred embodiment according to the present invention with reference to FIGS. 2A and 2B. The cable comprises a cable core 1*c* consisting of insulated wires 1 having a conductor 1*a* surrounded by an insulation layer 1*b*. For example, conductor 1*a* having a diameter of 0.38 mm, formed of seven tin-plated copper strands of 0.127 mm in diameter, is covered with insulation layer 1*b* of extruded polyethylene having a thickness of 0.23 mm to form insulated wire 1 of 0.84 mm in diameter. A pair of wires 1 and 1 are stranded in a pitch of 10 to 30 mm, varying from pair to pair. 13 pairs of wires 1 and having different pitches are assembled to form cable core 1*c*.

Figure 2A:
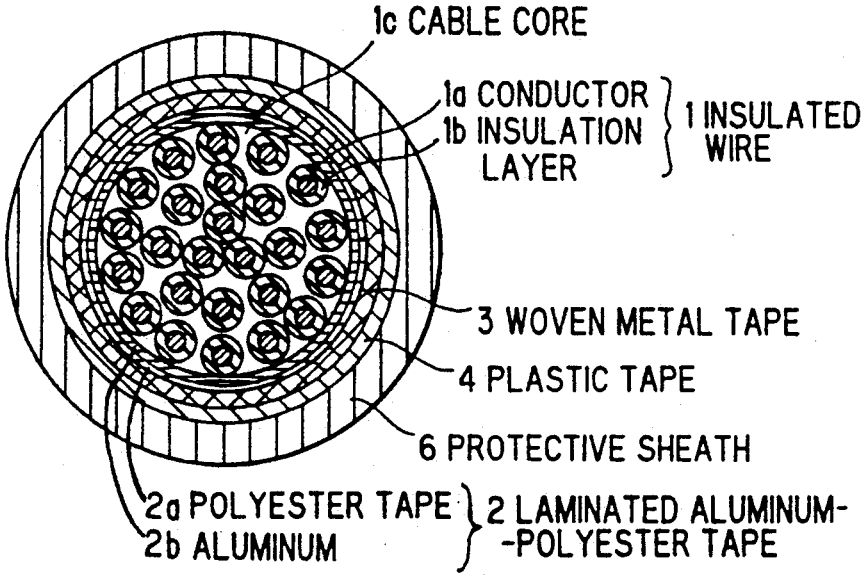
FIG. 2A and FIG. 2B show respectively a crosssectional view and an exploded elevation of a metal-shielded cable for electronic devices in a preferred embodiment of the invention.
Figure 2B:
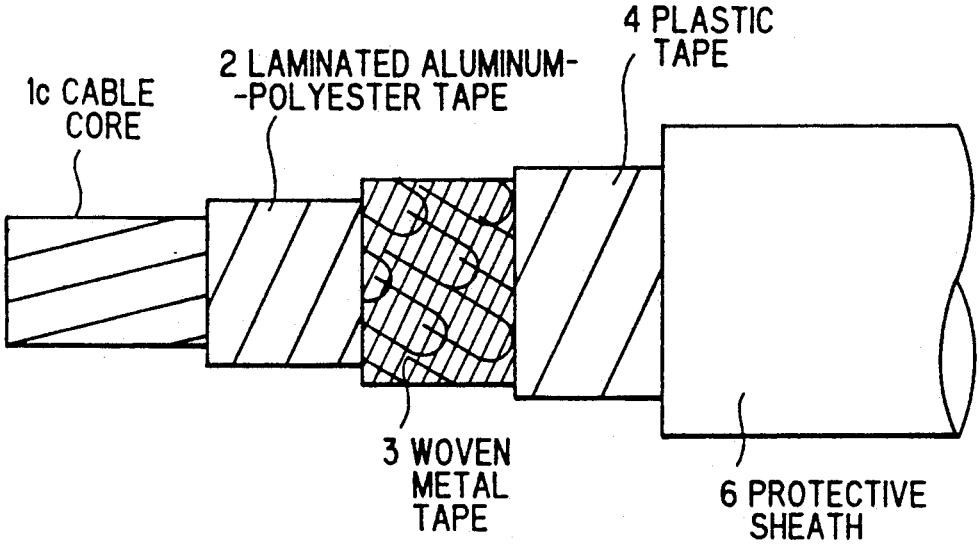

As shown in FIGS. 2A and 2B, a laminated aluminum-polyester tape 2 is wound around the cable core 1*c* forming a helicoid with its neighboring edge portions overlapping each other in one-third or a half width of the tape. For example, a laminated tape of 35 mm in width formed of an aluminum foil of 10 microns in thickness and a polyester film of 12 microns in thickness laminated thereon is wound helically around the cable core 1*c* with the metal foil outside so that one-third of the width may overlap the neighboring edge portion of the tape wound in another turn. Tape 3 of woven metal filaments is wound helically around the core covered with the laminated aluminum-polyester tape 2 so that one-third or a half of the width may overlap the neighboring edge portion, in the same manner as in winding of the laminated tape 2.

Figure 4:
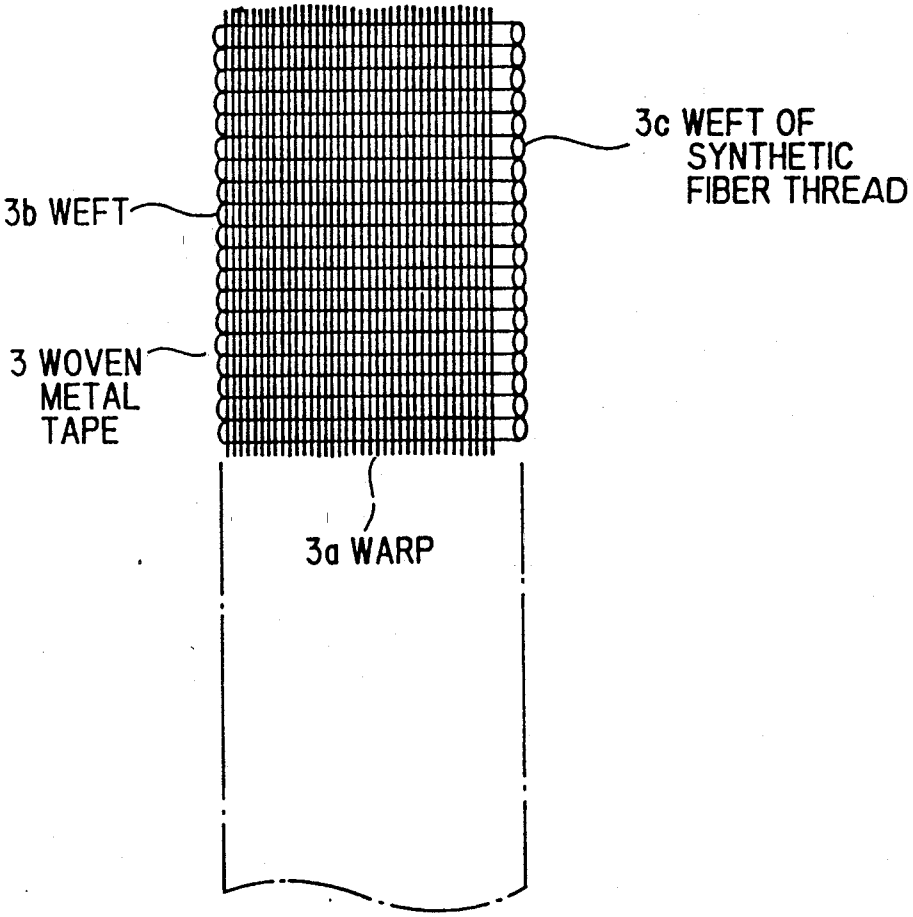
FIG. 3 and FIG. 4 show developments of exemplary woven metal shield layers.
Figure 3:
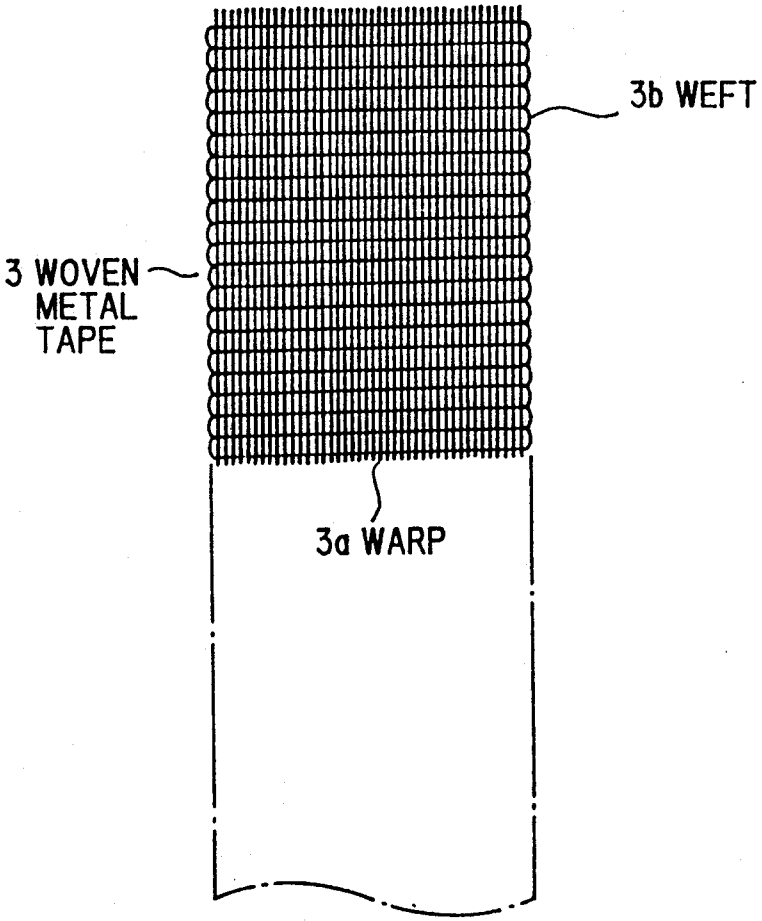

Examples of the structure of a layer formed of woven metal filaments are shown in FIG. 3 and FIG. 4. The woven metal tape shown in FIG. 3 is formed of warp 3*a* and weft 3*b*, either of plain woven metal threads, while FIG. 4 shows a tape in which threads of synthetic fiber 3*c*, for example, polyester, are used in the edge portions as warps, in combination with metallic wefts 3*b* and metallic warps 3*a*. An example of woven metal tape is a woven copper tape of 35 mm in width in which tin-plated soft copper filaments of 0.12 mm in diameter are plain woven in a pitch of 1.5 mm, with 190 warps and 2 wefts in combination.

In case where the flexibility of the cable is of great importance, all of the wefts may consist of synthetic fibers of high elasticity, for example, polyester fibers, whereby flexibility comparative to that of a cable having helical single wire shield is exhibited. Alternatively, a conductive wire having diameter of 0.2 mm or less formed of stranded metal filaments of 0.1 mm or less in diameter may be used as a warp, whereby the flexibility is improved without lowering the shield effect.

The shield layer formed of woven metal tape 3 may be fastened by an overlaying plastic tape 4. The composite metal shield comprising a metal-plastic laminate 2 and a layer of woven metal filaments 3 may be covered with a protective sheath 6, for example, an extruded polyvinylchloride layer having thickness of 1.1 mm. A drain wire for grounding the shield may be interposed between the tapes 2 and 3.

A conventional metal-shielded cable for comparison was prepared such that it had a braided metal shield in place of a woven metal tape. The braided metal shield was composed of 16 stranded wires each consisting of 12 strands of tin-plated soft copper filaments of 0.12 mm in diameter braided in a pitch of 38 mm at a braiding density of 90%.

Figure 5:
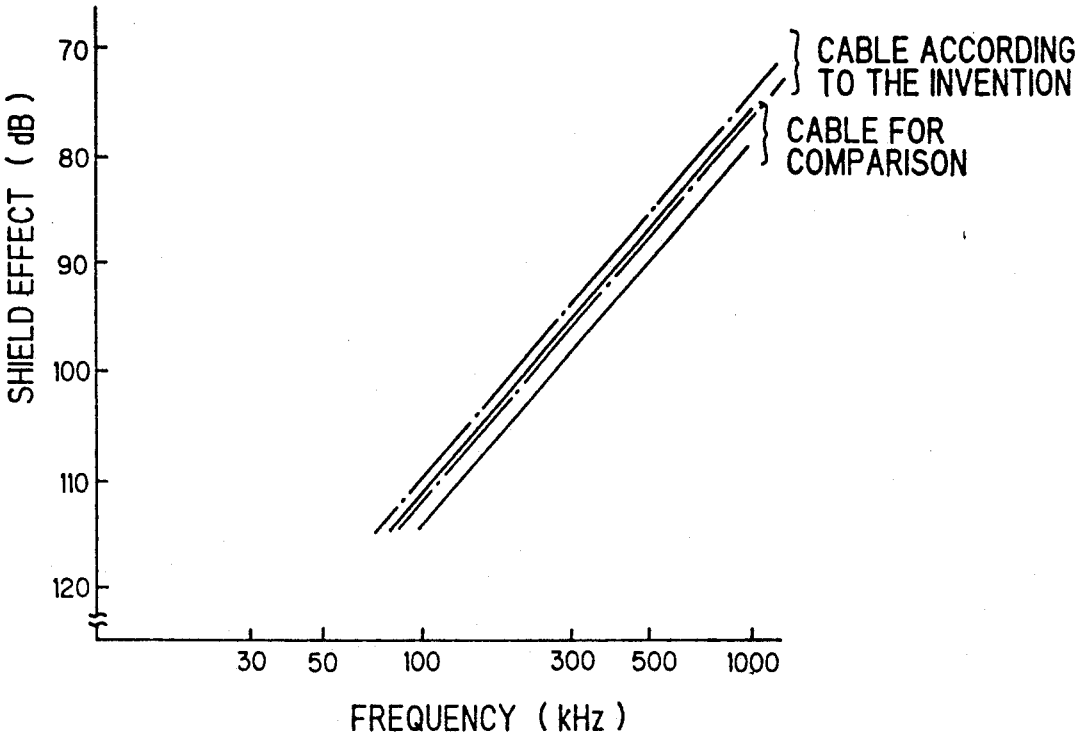
FIG. 5 shows a graph illustrating shield effects measured with a metal-shielded cable according to the invention and a conventional metal-shielded cable.

The shield effect measured for the cable according to the invention and the cable for comparison respectively is shown in FIG. 5. It is found that the cable according to the invention is comparative to the cable for comparison of conventional structure with respect to the shield effect.

Figure 6:
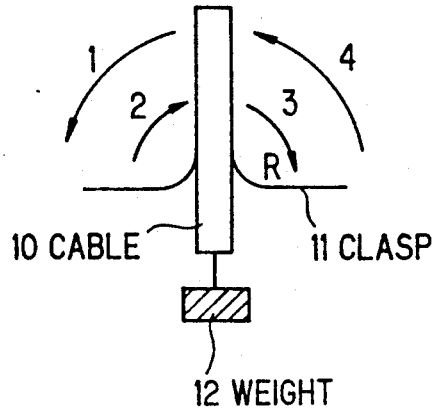
FIG. 6 shows an explanatory view showing the method used for bending test of cables.

Effect of bending on the aforementioned cable according to the invention and the cable for comparison, respectively, was measured by the method shown in FIG. 6, wherein all of the conductors (1*a* in FIG. 2A) in a cable specimen 10 of a specified length are connected in series, to have test terminals across which a voltage of several volts is applied by a constant voltage source, the cable specimen 10 is pinched by means of a clasp 11 having a curvature R, drawn by weight 12 of 1.0 kg suspended at the lower end of the cable specimen 10, and bent around the curvature R of 19 mm in diameter in the directions shown by arrows 1, 2, 3 and 4 respectively, in this order, in such a manner that bending once in one direction is followed by another bending in the next direction. A series of bendings in the directions 1 to 4 were repeated at a rate of 30 rounds per minute until the increase in electric resistance by 20% versus the initial value was observed. The number of bending required for 20% increase in resistance was counted for five specimens of the cable according to the invention and the cable for comparison, respectively. The results are shown in Table 1. It is found that the cable according to the invention is far less susceptible to repeated bending, compared to the conventional cable for comparison.

TABLE 1

| Specimen | Times of bending |
|---|---|
| Invention No. | |
| 1 | 10,430 |
| 2 | 15,957 |
| 3 | 4,856 |
| 4 | 4,976 |
| 5 | 9,447 |
| average | 9,133 |
| Comparison No. | |
| 1 | 2,730 |
| 2 | 1,617 |
| 3 | 4,698 |
| 4 | 5,111 |
| 5 | 5,063 |
| average | 3,844 |

Another preferred embodiment of a metal-shielded cable according to the present invention will be explained in detail with reference to FIGS. 7A and 7B. Similar to the cable shown in FIG. 2A, the cable comprises a core 51 consisting of insulated wires 1 each having a conductor la surrounded by an insulation layer 1*b*. For example, conductor la having a diameter of 0.38 mm, formed of seven tin-plated copper strands of 0.127 mm in diameter, is covered with insulation layer 1*b* of extruded heat-resistant polyvinylchloride having a thickness of 0.33 mm to form insulated wire 1 having diameter of 1.04 mm. 25 wires 1 and 1 are assembled to form cable core 51.

Figure 7A:
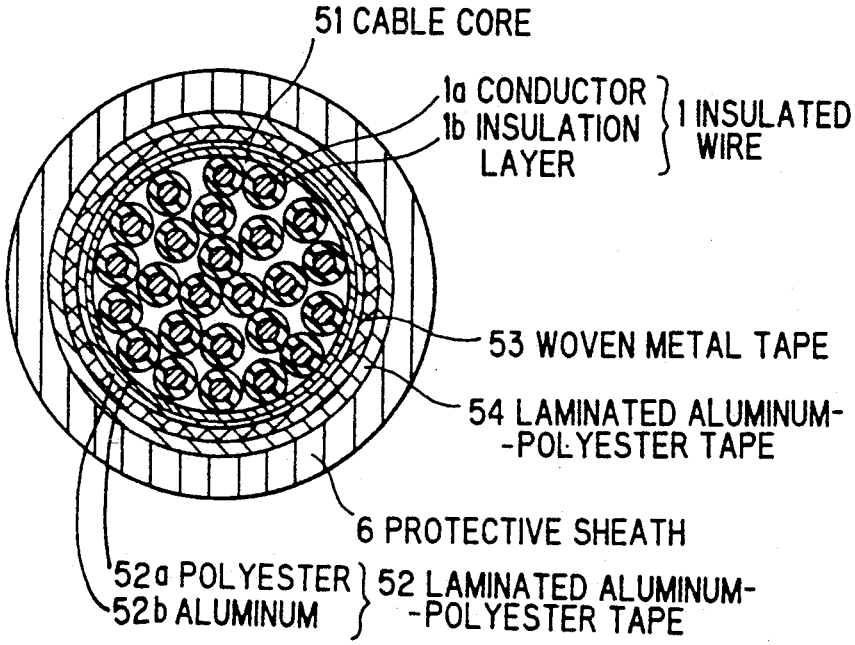
FIG. 7A and FIG. 7B show respectively a crosssectional view and an exploded elevation of a metal-shielded cable for electronic devices in another preferred embodiment of the present invention.
Figure 7B:
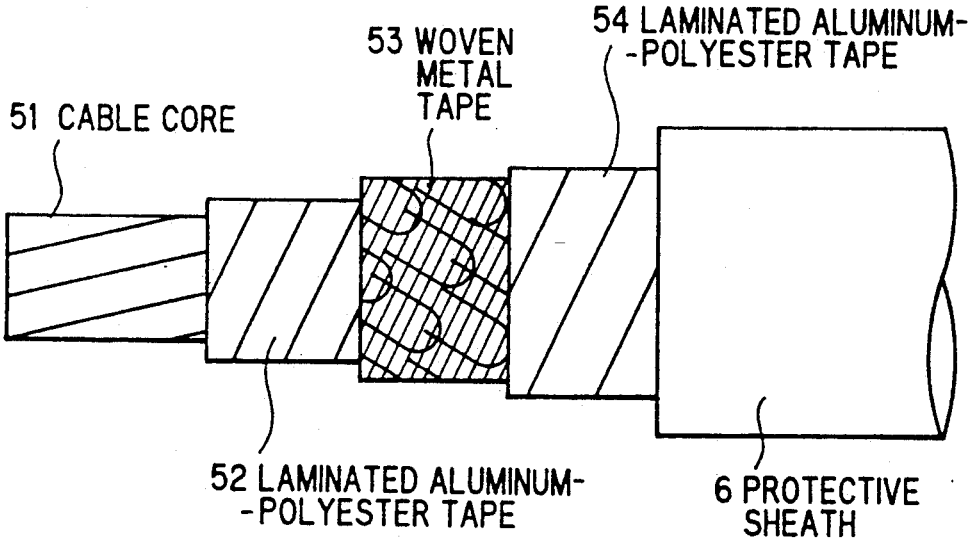

As shown in FIGS. 7A and 7B, a first laminated aluminum-polyester tape 52 is wound around the cable core 51 forming a helicoid with its neighboring edge portions overlapping each other in one-third or a half width of the tape. For example, a laminated tape of 30 mm in width formed of an aluminum foil of 10 microns in thickness and a polyester film of 12 microns in thickness laminated thereon is wound, with the metal foil outside, helically around the cable core 51 so that one-third of the width may overlap the neighboring edge portion of the wound tape. Alternatively, laminated tape 52 may be aligned along core 51, with its edge portions overlapping respective neighboring portion.

Tape 53 of woven metal filaments is wound helically around the core 51 covered with the laminated aluminum-polyester tape 52 so that one-fourth or one-third of the width may overlap the neighboring edge portion. An example of woven metal tape is a woven copper tape of 30 mm in width in which 130 warps and single weft of copper are plain woven in a pitch of 1.5 mm, the warps being tin-plated soft copper filament of 0.12 mm in diameter and the weft being stranded copper wire formed of seven tin-plated annealed copper filaments of 0.12 mm in diameter, wound helically with the neighboring edge portions overlapping each other in width of 9 to 12 mm. Alternatively, woven metal tape 53 may be aligned along core 51 covered with laminate 52.

Second laminated aluminum-polyester tape 54 is wound to cover the surface of woven metal tape 53 which surrounds cable core 51 and laminated aluminum-polyester tape 52, forming a helicoid, with its edge portions overlapping the respective neighboring portion in width one-fourth or one-third of the tape. An example of second laminated aluminum-polyester tape 54 is a laminated tape of 35 mm in width formed of an aluminum foil of 10 microns in thickness and a polyester film of 12 microns in thickness laminated thereon, wound helically with the neighboring edge portions overlapping each other in width of 12 to 18 mm. Alternatively, second laminated aluminum-polyester tape 54 may be aligned along the covered core (51+52+53). The layer formed of second laminated aluminum-polyester tape 54 may be wrapped further by a plastic tape to fasten it up.

The composite shield layer comprising two metal-plastic laminates 52,54 and a woven metal layer 53 interposed therebetween may be covered with a protective sheath 6, for example, an extruded polyvinylchloride layer having thickness of 0.81 mm. A drain wire for grounding the shield may be interposed between tape 52 and tape 53 or between tape 53 and tape 54, though it is not shown in FIGS. 5A nor 5B.

Figure 9A:
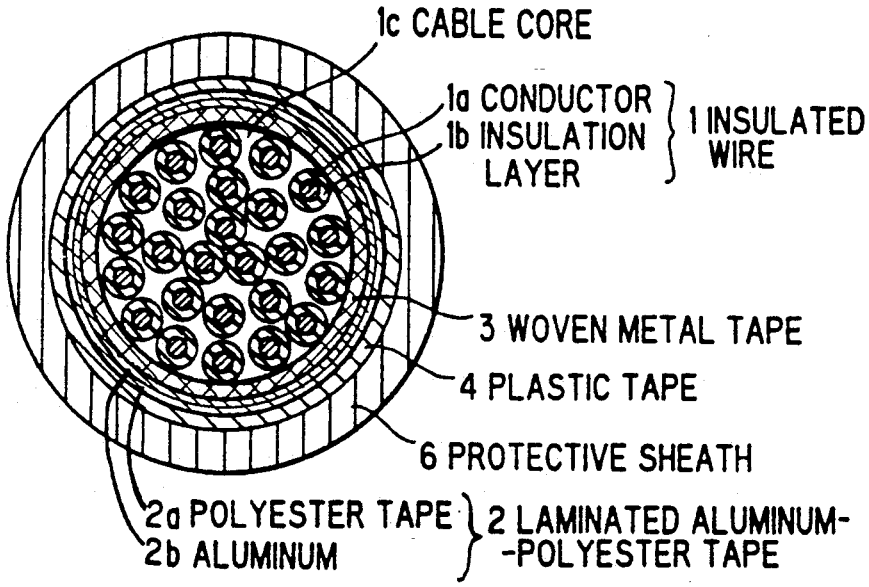
FIG. 9A and FIG. 9B show respectively a cross-sectional view and an exploded elevation of a metal-shielded cable for electronic devices of yet another embodiment of the invention.
Figure 9B:
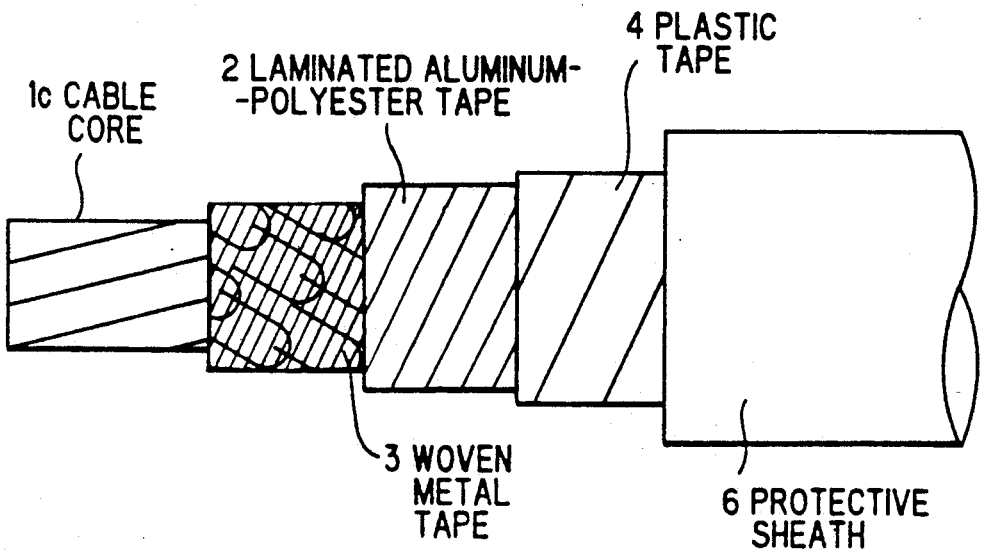

FIGS. 9A and 9B show an embodiment in which tape 3 formed of woven metal filaments is interposed between the core 1*c* and a laminated metal plastic layer or tape 2.

A cable for comparison was prepared in a manner similar to the second preferred embodiment except using a conventional braided metal shield in place of the plain-woven metal shield. The braided metal shield was composed of 16 stranded wires each consisting of 12 strands of tin-plated annealed copper filaments of 0.12 mm in diameter braided in a pitch of 34 mm at a braiding density of 90%.

Figure 8:
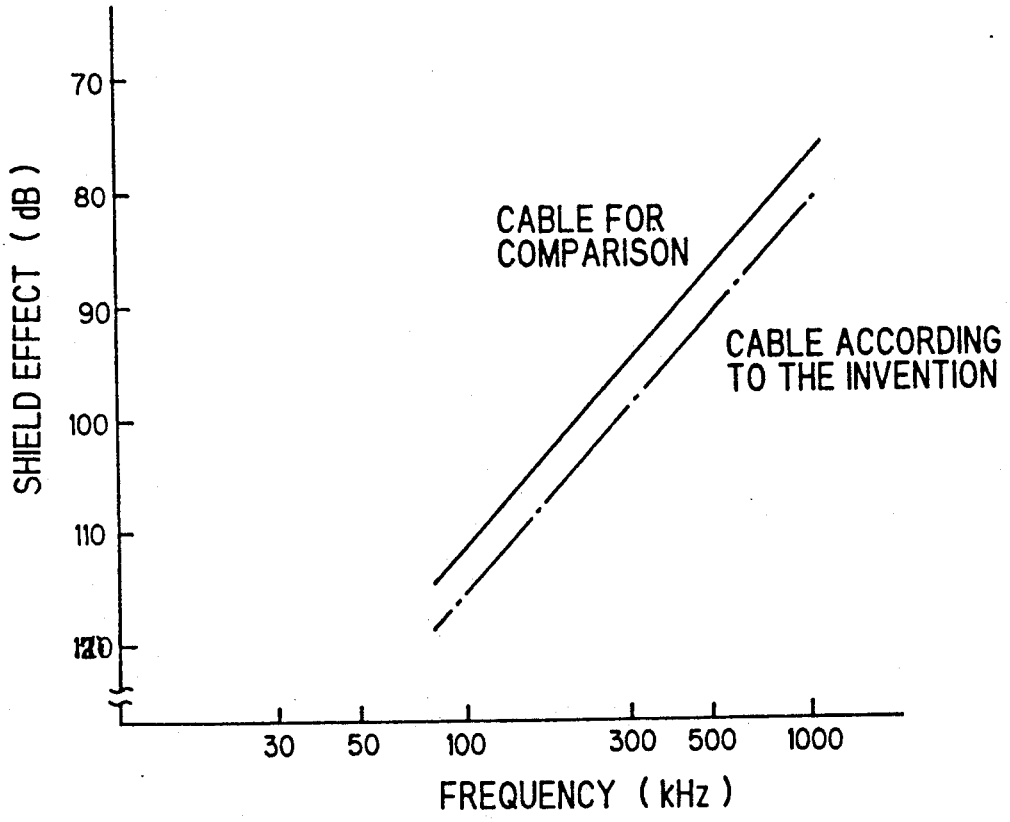
FIG. 8 shows a graph showing shield effects measured with a metal-shielded cable in another preferred embodiment of the invention and a conventional metal-shield cable.

Shield effect was measured with the aforementioned cable in the second preferred embodiment according to the invention and the cable for comparison, respectively. The results were shown in FIG. 8. A remarkably improved shield effect was exhibited by the cable in the second preferred embodiment of the invention compared with the conventional metal-shielded cable.

A metal-shielded cable for electronic devices according to the invention can be manufactured in an improved efficiency, because a woven metal tape previously prepared can be used to form the metal-shield in place of braiding metal wires around the cable core running in the manufacturing process. Metal shield of composite structure consisting of laminated metal-plastic tape and woven metal layer, according to the invention, are formed in two steps which can be carried out in a sequence within a very short time, at a high speed on a single production line, whereby the time required for the production of complete cable is remarkably shortened and the cost is reduced.

A metal-shielded cable for electronic devices according to the invention is improved in flexibility compared to a conventional cable having braided metal-shield, so as to permit bending of the cable in any direction owing to the ease of relative movement between the neighboring parts of the cable, as well as it is easy to remove the shield from the cable in the terminal portion, because the shield layers can be removed by unwinding the tapes of metal-plastic laminate and woven metal without the need for cutting the metal wires one by one.

A metal-shielded cable for electronic devices according to the invention exhibits shield effect equal or superior to a conventional cable having braided metal-shield.

Although the invention has been described with respect to specific embodiments for complete and clear disclosure, the appended claims are not to thus limited but are to be construed as embodying all modifications and alternative constructions that may occur to one skilled in the art which fairly fall within the basic teaching herein set forth.

What is claimed is:

1. A metal-shielded cable having a cable core consisting of insulated wires each having a conductor covered with an insulation layer, said cable core being surrounded by a composite metal shield having a laminated metal-plastic layer and a shield layer formed of metal filaments in combination wherein:

said shield layer comprises a tape formed of woven metal filaments, said tape being wound helically around or aligned longitudinally along said cable core, with edge portions thereof partly overlapping a respective neighboring edge.

2. A metal-shielded cable as defined in claim 1 wherein said tape formed of woven metal filaments is interposed between said cable core and said laminated metal-plastic layer.

3. A metal-shielded cable as defined in claim 1 wherein said laminated metal-plastic layer is interposed between said cable core and said shield layer formed of metal filaments.

4. A metal-shielded cable as defined in claim 1 wherein said laminated metal-plastic layer comprises a laminated metal-plastic tape wound helically around or aligned along the cable core, with the edge portions thereof partly overlapping the respective neighboring edge.

5. A metal-shielded cable as defined in claim 1 wherein said laminated metal plastic layer is a first laminated metal plastic layer and said composite metal shield further includes a second laminated metal plastic layer and said shield layer is interposed between said first laminated metal-plastic layer and said second laminated metal plastic layer.

6. A metal-shielded cable as defined in claim 1 wherein said laminated metal-plastic layer has a metal layer in contact with said shield layer formed of woven metal filaments.

7. A metal-shielded cable as defined in claim 6 wherein said laminated metal-plastic layer comprises a laminated metal-plastic tape wound helically around or aligned along the cable core, with the edge portions thereof partly overlapping the respective neighboring edge.

8. A metal-shielded cable as defined in claim 1 wherein said tape formed of woven metal filaments contains synthetic fibers.

9. A metal-shielded cable as defined in claim 8 wherein said tape formed of woven metal filaments comprises a warp formed of synthetic fibers.

10. A metal-shielded cable as defined in claim 8 wherein said tape formed of woven metal filaments comprises a weft formed of synthetic fibers.

11. A metal-shielded cable as defined in claim 8 wherein said tape formed of woven metal filaments comprises a warp and a weft formed of synthetic fibers, respectively.

12. A metal-shielded cable as defined in claim 8 wherein said synthetic fiber is polyester fiber.

13. A metal shielded cable as defined in claim 1 wherein said tape formed of woven metal filaments is formed by plain weaving.

14. A metal-shielded cable as defined in claim 1 wherein said insulated wires are stranded wires.

15. A metal-shielded cable having a cable core consisting of insulated wires each having a conductor converted with an insulation layer, said cable core being surrounded by a composite metal shield having a laminated metal-plastic layer and a shield layer formed on metal filaments in combination wherein:

said shield layer comprises a tape formed of woven metal filaments, said tape being wound helically around or aligned longitudinally along said cable core.

* * * * *